United States Patent [19]

Golla

[11] 4,347,661

[45] Sep. 7, 1982

[54] PROCESS OF MAKING ELECTRIC ASSEMBLIES

[75] Inventor: Franz Golla, Lünen, Fed. Rep. of Germany

[73] Assignee: Gewerkschaft Eisenhutte Westfalia, Lüunen, Fed. Rep. of Germany

[21] Appl. No.: 83,733

[22] Filed: Oct. 10, 1979

[30] Foreign Application Priority Data

Oct. 11, 1978 [DE] Fed. Rep. of Germany ..... 2844222

[51] Int. Cl.[3] ..... H01R 43/00

[52] U.S. Cl. ..... 29/879; 29/592 R; 204/286; 204/294; 228/118; 219/9.5

[58] Field of Search ..... 204/286, 290 R; 228/118; 29/402.08, 707, 240, 240.5, 281.4, 281.5, 402.05, 402.06, 402.07, 402.11, 402.13, 402.03, 825, 860, 592, 879; 219/9.5; 164/338.1

[56] References Cited

U.S. PATENT DOCUMENTS

| | | | |
|---|---|---|---|
| 2,919,641 | 11/1959 | Yuhasz | 219/9.5 |
| 3,037,928 | 6/1962 | Hass et al. | 204/286 |
| 3,398,081 | 8/1968 | Bonfils et al. | 204/286 |
| 3,437,579 | 4/1969 | Smith | 204/286 X |
| 3,489,668 | 1/1970 | Anton et al. | 204/286 |
| 3,536,460 | 10/1970 | Voelker | 204/286 |
| 3,738,918 | 6/1973 | Johnson | 204/290 R |
| 3,867,562 | 2/1975 | Fischer et al. | 204/286 X |

FOREIGN PATENT DOCUMENTS

| | | | |
|---|---|---|---|
| 356311 | 3/1973 | U.S.S.R. | 204/286 |

*Primary Examiner*—Francis S. Husar
*Assistant Examiner*—Carl J. Arbes
*Attorney, Agent, or Firm*—Sughrue, Mion, Zinn, Macpeak & Seas

[57] ABSTRACT

Metallic anode holders are suspended by a conveyor, and moved in succession above a table supporting induction-heating coils. The coils can be raised to surround lower depending parts of the holders which may be optionally previously coated with a separating agent to prevent direct contact with the grouting subsequently applied. The associated anode carbon blocks with recesses are conveyed successively beneath a beam supporting induction-heating coils which can be lowered into the recesses which subsequently receive the parts of the holders for grouting therein. It is possible to heat the recesses and the parts of the holders in situ and simultaneously, in which case the grouting operation can be performed without letting the components cool down. Metallic cathode busbars previously installed in a recess of a carbon block are likewise conveyed beneath a beam supporting an induction-heating coil, which serves to heat the busbars and the recess prior to grouting the busbars in the recess.

17 Claims, 4 Drawing Figures

PROCESS OF MAKING ELECTRIC ASSEMBLIES

BACKGROUND TO THE INVENTION

The present invention relates to a process of, and apparatus for, treating and producing components for use as anodes and cathodes in electrolytic smelting plants.

In electrolytic smelting plants for furnaces producing aluminum, use is made of consumable carbon anodes and cathodes. Normally, the anodes and cathodes are formed as assemblies composed of blocks of carbon fixed to metallic support members. More particularly, the anodes, which are to be vertically displaceable during use, are composed of carbon anode blocks fixed to steel holders used to support the anode blocks and for supplying electrical current thereto. Similarly, the cathodes are composed of carbon cathode blocks fixed to busbars made, for example, from copper and used for supplying electrical current thereto.

To afix the aforesaid metallic members to the carbon blocks, it is usual to provide recesses in the carbon blocks which receive parts of the metallic members and to employ liquid cast iron poured into the recesses as grouting. During the smelting process, the carbon blocks are consumed. Although the anodic carbon blocks are consumed at a faster rate, the cathodic carbon blocks are also consumed. In order to save costs, it is desirable to strip off the carbon residues and to re-use the holders and busbars with fresh carbon blocks. To enable this stripping operation to be effected without damaging the holders and busbars, it is known to precoat these components with an agent, such as a water/-graphite dispersion, to create a separation layer between the cast iron grouting and the metal surfaces. This agent is applied as a liquid or viscous substance to the connection zones of the holders and busbars prior to grouting. When the cast iron solidifies as an annular mass around the metallic holders and busbars, it does not directly contact the metal surfaces and hence subsequent separation is easier. The presence of water in the recesses of the carbon blocks and on the connection zones of the metallic members, i.e., the holders and busbars, is to be avoided in any event since, during grouting, bubbles of steam can create cracking or dispersions in the cast iron which can in turn lead to obvious difficulties. It is thus necessary to dry adequately both the recesses in the carbon blocks and the connection zones of the metallic members, especially when a pre-coating agent is applied, prior to grouting. Hitherto this drying step has taken a great deal of time and represents a production bottleneck, seriously affecting the efficiency of a continuous flow process. To promote the necessary drying, it has been known hitherto to place the components in question in a heating chamber heated by oil or gas burners. Primarily to accelerate the drying of the pre-coating or separation layer, it has also been known to expose the layer and also the recesses in the carbon blocks directly to combustion flames. This can involve considerable noise and discomfort to operators. In any event, this process is not wholly satisfactory, since uneven heating can result and the separation layer then cracks or burns. Discontinuities in the separation layer are disadvantageous, since the cast iron grouting can directly contact the metal surfaces and subsequent stripping of the cast iron is made more difficult. All the conventional drying operations involve considerable expense. In a typical plant, for instance, using oil as a fuel, sone 160 Kg of oil is consumed in one hour and, in addition, 4,000 liters of air are needed. The conventional drying operations are also inefficient, since a large proportion of the thermal energy is wasted.

A general object of the present invention is to provide an improved process of, and apparatus for, treating and assembling components as aforementioned.

SUMMARY OF THE INVENTION

According to one aspect of the present invention, there is provided a process for treating metallic and carbon components used to form anode and cathode assemblies for electrolytic smelting; said process involving heating each of the components from within prior to final assembly.

The invention also provides apparatus for treating or drying metallic and carbon components for forming anode and/or cathode assemblies used in electrolytic smelting; said apparatus comprising energy-generating means carried by displaceable support means which serves to bring the energy-generating means into a position in proximity with a selected region of at least one of a succession of said components to permit the energy-generating means to effect heating of said component from within prior to assembly.

The treatment or drying by heating as aforesaid preferably forms part of a continuous production or assembly process producing anode or cathode assemblies. Thus, in another aspect, the invention provides a process for producing anode and cathode assemblies for use in electrolytic smelting; said process comprising successively coating parts of metallic members with an agent intended to create a separation layer with respect to grouting material utilized in a subsequent operation, drying recessed carbon blocks and the coated parts of the metallic members by heating these components in at least selected regions from within and grouting the parts of the metallic members into the recesses of the carbon blocks. The metallic members and recessed carbon blocks can be heated entirely separately prior to their assembly and grouting or the metallic members and recessed carbon blocks can be heated together.

The pre-coating of the metallic members is not absolutely essential and in another aspect, the invention provides a process for producing anode and cathode assemblies for use in electrolytic smelting; said process comprising arranging parts of metallic members within recesses in carbon blocks, heating said parts and the walls of the recesses to a temperature in excess of 600° C. by heating these components from within and grouting the parts of the metallic members into the recesses while still at elevated temperature.

The heating operation can be performed by generating heat within the components without physical contact therewith and microwave generating means, ultrasonic generating means or induction heating means can be employed for this purpose. Preferred embodiments of the invention embody one or more induction heating coils. A plurality of such coils carried by a table or beams can be brought into a position surrounding the arms of a metallic anode holder and/or within the recesses of a carbon block for receiving these arms prior to grouting. In an analogous arrangement, a single elongate coil can be brought into a position closely adjacent one or more metallic cathode busbars inside a recess of a carbon block to heat these components simultaneously prior to grouting. The heating operation can be controlled by temperature sensing or by timing.

The components are preferably conveyed in succession by conveying means through a station whereat the heating process is performed and through a station whereat the grouting process is performed and, optionally, through a station whereat the precoating is performed. One useful arrangement is to have the induction heating coil or coils supported by means displaceable in the same direction as the conveying means and in the reverse direction. In this way, the components or assemblies can be treated in turn while they are being conveyed by synchronizing the speed of the displaceable means with the conveying means and then moving the displaceable means back to take up the next component or assembly.

The heating operation performed in accordance with the invention is efficient and fine control of the heat is possible enabling the desired regions to be raised in temperature evenly and with precision and without the uneven and rapid heating which characterizes the known heating processes. By performing the grouting operation before the components have cooled down to ambient temperature any tendency to re-absorb moisture can be overcome.

BRIEF DESCRIPTION OF THE DRAWINGS

Embodiments of the invention will now be described, by way of example only, with reference to the accompanying drawings, wherein.

DESCRIPTION OF PREFERRED EMBODIMENTS

Figure 1:
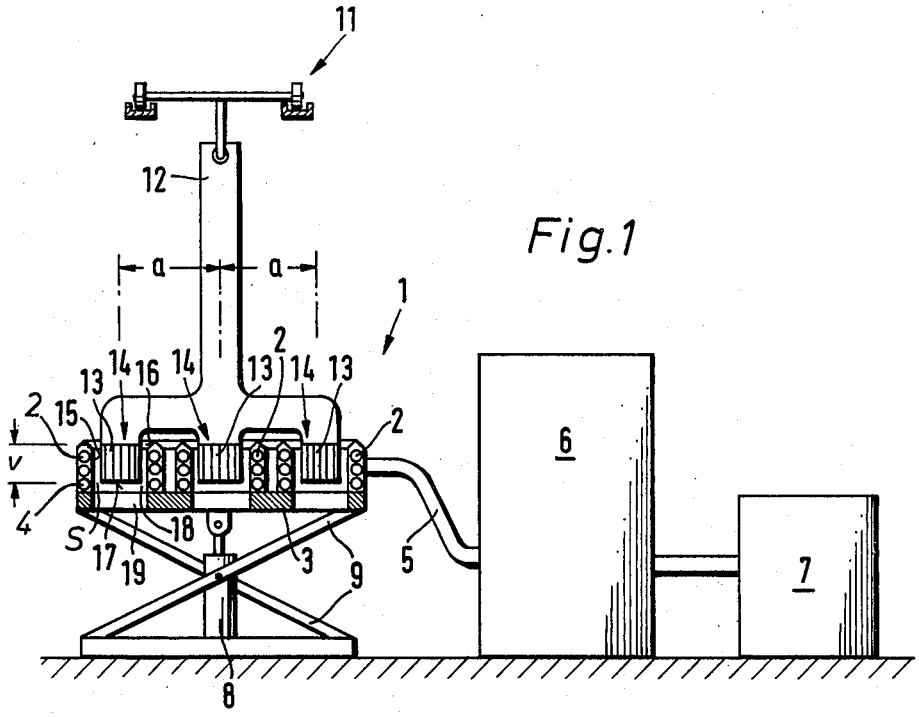
FIG. 1 is a schematic representation of apparatus made in accordance with the invention.

As shown in FIG. 1, apparatus made in accordance with the invention is generally designated 1 and employs a table 3 which can be raised and lowered by means of a device such as a hydraulic piston and cylinder unit 8, as shown. The unit 8 is upstanding. The unit 8 has its cylinder supported on a floor-engaging block and its piston rod pivotably coupled to a bracket on the underside of the table 3. Scissor-like pivotable guide levers 9 interconnect the block to the table 3 and are linked to the cylinder of the unit 8. The unit 8 can be extended or retracted to raise or lower the table 3 and the unit 8 with the levers 9 can maintain the table 3 in any set height position. The table 3 carries heating means in the form of three spaced-apart induction coils 2. The coils 2 are constructed from water-cooled copper pipes 4 lined with a heat-resisting material. The coils 2 are energized with an a.c. supply at a frequency of 4 KHZ, for example. As depicted, a flexible conduit 5 containing electrical conductors and water supply pipes is connected to the coils 2 and to a switch or control box 6. A transformer unit 7 supplies the energizing current for the coils 2 and is connected to the control box 6 conveniently by way of a further flexible conduit.

A transporting or conveying appliance 11 is shown as disposed above the table 3. In the simplified form as depicted, the appliance 11 has U-shaped rails supporting wheels or rollers mounted on axles. From each axle and roller assembly there is suspended a device 12 made from steel and used for holding the carbon anodes of an electrolytic aluminium smelting plant and for supplying electrical current thereto. Each device 12 has a main limb detachably connected to the axle of an associated assembly, and three lower arms 13 which are to be subsequently fixed to a carbon anode block. The axle and roller assemblies move the devices 12 through a series of working stations, including a station whereat the arms 13 of the device 12 in question are subsequently grouted into recesses in the associated anode block with liquid cast iron. The axle and roller assemblies would normally move the devices 12 from station to station in a stepwise sequence. Where the apparatus 1 constructed in accordance with the invention is not needed to operate, the table 3 can be retracted with the unit 8 to permit the devices 12 to pass unimpeded over the apparatus 1.

In performing a pre-treatment process in accordance with the invention, the arms 13 of the devices 12 are immersed in turn in a dispersion of water and graphite over a zone V and the devices 12 are heated and dried by the apparatus 1 prior to the grouting operation discussed above. The water and graphite dispersion serves to create a separation layer between the arms 13 and the subsequent cast iron grouting. The arms 13 of the devices 12, preimmersed as aforesaid, have a liquid layer 14 of graphite and water thereon over the zone V, and, in practising the invention, the table 3 of the apparatus 1 is raised to an extent sufficient to ensure that the zones V of the arms 13 of each device 12 pass through the respective coils 2. It follows that the spacing 'a' between the centres of the coils 2 corresponds to the spacing between the adjacent arms 13 of the device 12. The interior cross-sections 19 of the coils 2 are dimensioned so that there is sufficient clearance 's' between the interiors of the coils 2 and the lateral exterior surface 15 of the arms 13. Also, clearance is provided between the upper turns of the coils 2 (conveniently tapered or recessed as at 16). It is thus ensured the arms 13 are accommodated within the coils 2 without physical contact. The table 3 is apertured or perforated as at 18 below the coils 2 to allow the still-liquid separation dispersion to drip from the arms 13. Once the arms 13 of one of the devices 12 are positioned within the coils 2, switching means (not shown) energizes the coils 2 with an alternating current. The coils 2 then induce heating currents in the arms 13 and the layer 14 thereon. The heat generated may be primarily in the outer surfaces 15 of the arms 13 and in the lower end face 17, as well as in the layer 14 thereon. A gentle even thermal gradient can be produced which dries the separation layer 14 without the formation of cracks. During tests based on the apparatus 1, the layer 14 on the arms 13 was effectively dried in 90 seconds with a temperature of about 175° C. being achieved in the layer 14 itself. The heating cycle can be controlled by means of a time switch which disables the heating current after a pre-determined exposure time. Alternatively, a temperature sensor may control the operation of the induction coils 2. Once the layers 14 on the arms 13 have been dried adequately, the table 3 can be lowered to permit the device 12 to be transported to the next station where the grouting of the device 12 into the carbon anode blocks takes place. During this process step, the arms 13 are positioned within recesses in the carbon anode block and liquid cast iron is poured into the recesses to bond the arms 13 to the anode block to produce an anode assembly.

Figure 2:
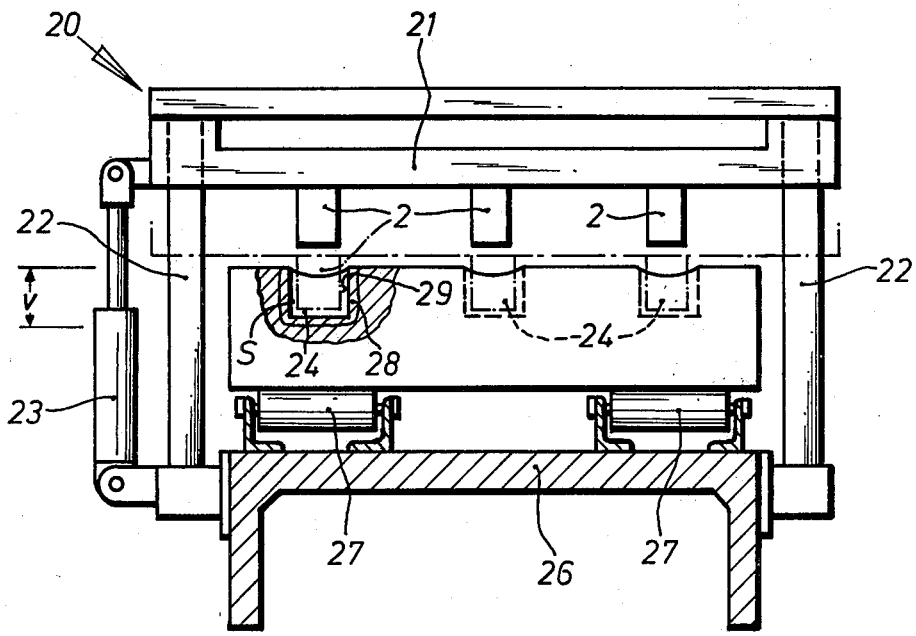
FIG. 2 is a schematic representation of another apparatus made in accordance with the invention.

FIG. 2 depicts another apparatus designated 20 constructed in accordance with the invention, which is used to treat the carbon anode blocks prior to assembly with the devices 12. In the apparatus 20, induction coils 2, as described above in connection with FIG. 1, are supported on the lower side of a beam 21. The beam 21 can be raised and lowered. To achieve this, the beam 21 is guided on vertical rods 22 and is connected through a hydraulic piston and cylinder unit 23 supported with the rods 22, on a trestle or frame 26. The frame 26 also supports a series of rollers 27 forming a conveying track along which a series of carbon anode blocks 25 are conveyed. Each anode block 25 is conveyed along the track and positioned in turn beneath the coils 2 on the beam 21. The anodes 25 are provided with recesses 24 therein and the coils 2 are positioned to correspond with the recesses 24. Control means (not shown) preferably ensures that each anode 25 becomes correctly positioned beneath the beam 21 with the recesses 24 aligned with the coils 2. The beam 21 is then lowered by means of the unit 23 to bring the coils 2 into the recesses 24 with adequate clearance 's' to avoid physical contact, as shown in the chain-dotted lines in FIG. 2. When positioned in this manner, the coils 2 are energized by alternating current to induce heating currents within the anode block 25 and the heating effect can be primarily in the marginal layers 28 around the recesses 24. Any moisture present on the walls 29 of the recesses 24 is vaporized by this induction heating, and, after a pre-set time or temperature, the beam 21 is raised and the coils 2 are de-energized ready for the next operative cycle. The process of drying the anode blocks 25 with the apparatus 20 would also be a preliminary treatment prior to the grouting-in of the devices 12 treated by the apparatus 1 of FIG. 1.

Instead of treating the devices 12 and the anode carbon blocks 25 separately with the respective apparatuses 1 and 20 of FIGS. 1 and 2, it is possible to utilize a single apparatus to treat or dry the devices 12 and the anode blocks 25 together in one operation prior to grouting. This modified apparatus, not shown in the drawings, would employ induction heating coils, which would become positioned between the arms 13 of a device 12 over the zones V and the surrounding walls 29 of the recesses 24 in an anode block 25. Such a process can be performed without the pre-coating mentioned above and, in such a case, the grouting operation is performed while the devices 12 and the carbon blocks 25 are still at elevated temperature.

Figure 3:
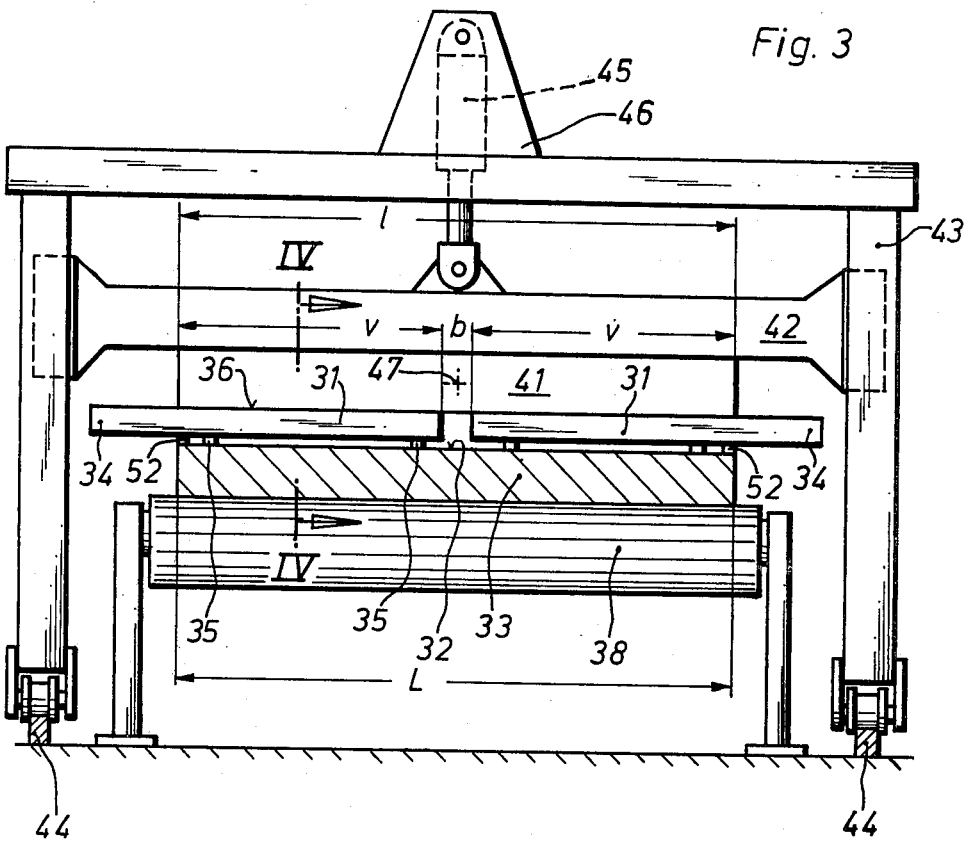
FIG. 3 is a schematic representation of a further apparatus made in accordance with the invention.
Figure 4:
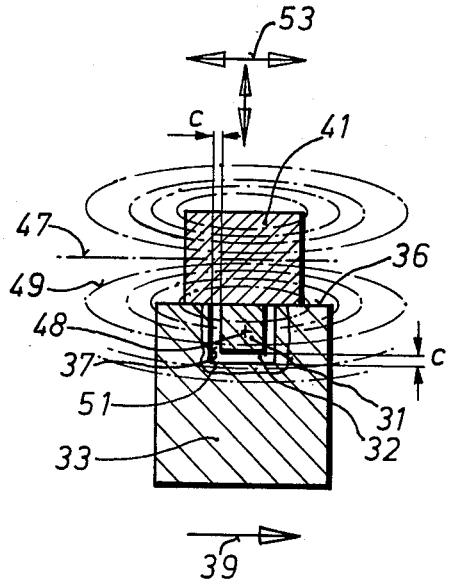
FIG. 4 is a schematic sectional view taken along the line IV—IV of FIG. 3.

FIGS. 3 and 4 depict a further apparatus made in accordance with the invention used for treating busbar/cathode assemblies complementary to the anode/-holder assemblies 12,25 described above. In the apparatus of FIGS. 3 and 4, an induction coil 41, constructed as described in connection with FIG. 1, is supported on the lower side of a beam 42. The beam 42 can be raised and lowered by means of a hydraulic piston and cylinder unit 45. The unit 45 is mounted between the beam 42 and a bracket 46 or the like provided on an inverted U-shaped gantry 43. The gantry 43 has upstanding side frame members supported as by rollers for displacement along guide rails 44. A track or conveyor 38, composed, for example, of rollers mounted on supports, extends parallel to the rails 44 beneath the gantry 43. The apparatus serves to treat cathode/busbar assemblies used in connection with an electrolytic aluminium smelting plant. These assemblies are generally each composed of one or more busbars, usually copper, each installed within a recess in a carbon cathode block. The busbar or busbars is or are subsequently grouted into the recess in the carbon cathode blocks using cast iron as with the connection of the holding devices 12 to the carbon anode blocks described hereinbefore in connection with FIG. 1. Each busbar 12 can be optionally previously coated with a dispersion of graphite and water to form a separation layer as described previously with the anode holders 12. As shown in FIGS. 3 and 4, the cathode/busbar assemblies are moved along the conveyor track 38 in turn. Each assembly employs two busbars 31 located in a single open channel-shaped common recess 32 provided in the top face of a carbon cathode block 33. The recess 32 extends longitudinally of the cathode 33. The end regions 34 of the busbars 31 are used subsequently to establish electrical connection with the cathode 33 during electrolytic smelting. The busbars 31 are spaced apart centrally of the cathode block 33 by a distance "b", and, in the arrangement as illustrated, the busbars 31 rest on spacers 35 arranged at the bottom of the recess 32 to ensure the upper face of the busbars 31 are aligned with the upper face of the cathode block 33. As shown in FIG. 4, there is lateral clearance 'c' between each of the inner side walls 37 of the recess 32 and the corresponding sides of the busbars 31. The cathode/busbar assemblies 33,31 extend transversely of the conveyor track 38 and pass in succession to a position beneath the beam 42. The assemblies can be conveyed continuously since the gantry 43 can be moved in synchronism with the motion of the assemblies along the conveyor 38, while the coil 41 performs its heating function. Thereafter, the gantry 43 can move in a reverse sense to bring the beam 42 to a position above the next assembly. This forward and reverse motion of the gantry 43 is represented in FIG. 4 by the double-arrow 53, while the main conveying direction pertaining to the conveyor 38 is represented by the arrow 39. The induction coil 41 has a length "l" corresponding to the length of the cathode block 33. When aligned, the beam 42 is lowered to bring the coil 41 into an operating position and the coil 41 is energized with alternating current, as described previously.

As shown in FIG. 4, the electromagnetic axis 47 of the coil 41 extends transversely to the longitudinal axes 48 of the busbars 31 so that the lines of force 49 of the electromagnetic field pass across the busbars 31 and the recess 32. The heating effect produced by the coil 41 is such that, after a pre-determined time, the temperature of the busbars 31 over the regions 'V' of FIG. 3 and in the surface regions of the bottom wall 51 and side walls 37 of the recess 31 reaches 750° C. Once the heating time has elapsed, control means can ensure that the current supplied to the coil 41 is interrupted and the beam 42 is raised by the unit 45. This heating operation dries the cathode/busbar assemblies 33,31 so that the subsequent process step, when the busbars 31 are grouted into the recess 32 with liquid cast iron, can be accomplished at optimum speed to achieve a reliable bond. This grouting can be performed while the cathode/busbar assembly 33,31 is still at high temperature. During this grouting operation seals 52, shown in FIG. 3, would be arranged at the ends of the recess 32 to seal to the side walls 37 to prevent the cast iron from running out of the recess ends.

Depending on the size and other properties of the materials and the temperature gradients desired, the induction heating coils 2, 41 of the apparatuses depicted in the drawings can be energized with alternating current at medium or high frequency.

I claim:

1. Process for producing composite anode assemblies for use in electrolytic smelting, said process comprising transporting metallic holder members and recessed carbon blocks in succession through work stations, precoating end parts of the metallic members with an agent designed to create a separation layer with respect to a grouting material used in a subsequent bonding operation, locating displaceably-supported electrical coils around the pre-coated end parts of the metallic members without physical contact therewith, energizing the coils to dry the pre-coated end parts by induction heating in a controlled manner without cracking the coating, locating displaceably-supported electrical coils within the recesses in the carbon blocks without physical contact therewith, energizing the coils to dry the recesses by induction heating, locating the dried pre-coated end parts of the metallic members in the dried recesses, and bonding the metallic members to the carbon blocks by introducing a liquid grouting material into the recesses.

2. Process for producing composite cathode assemblies for use in electrolytic smelting, said process comprising transporting metallic bus bars and recessed carbon blocks in succession through work stations, precoating the bus bars with an agent adapted to create a separation layer with respect to a grouting material used in a subsequent bonding operation, locating the pre-coated bus bars in recesses in the carbon blocks, locating a displaceably-supported electrical coil in the vicinity of the bus bars and recesses, energizing the coil to dry the pre-coated bus bars and the recesses by induction heating in a controlled manner without cracking the coating, withdrawing the electrical coil, and bonding the bus bars into the recesses by introducing a liquid grouting material into the recesses.

3. Process for producing composite anode assemblies use in electrolytic smelting, said process comprising transporting metallic holder members and recessed carbon blocks in succession through work stations, precoating end parts of the metallic members with an agent designed to create a separation layer with respect to a grouting material used in the subsequent bonding operation, aligning the pre-coated end parts with respective recesses in the carbon blocks, locating displaceably-supported electrical coils around the pre-coated end parts and within the recesses without physical contact with the metallic members and the carbon blocks, energizing the coils to dry the pre-coated end parts and the recesses by induction heating in a controlled manner without cracking the coating, withdrawing the coils, locating the dried pre-coated end parts of the metallic members in the dried recesses and bonding the metallic members to the carbon blocks by introducing a liquid grouting material into the recesses.

4. Process for producing composite anode assemblies for use in electrolytic smelting, said process comprising transporting metallic holder members and recessed carbon blocks in succession through work station, aligning end parts of the metallic holder members with respective recesses in the carbon blocks, locating displaceably-supported electrical coils around the end parts of the metallic members and within the recesses without physical contact with the metallic members and carbon blocks, energizing the coils to dry the end parts and the recesses by induction heating in a controlled manner to bring the temperature of the end parts and the surfaces of the recesses to a value over 600° C., withdrawing the coils, locating the end parts of the metallic members to the carbon blocks by introducing a liquid grouting material into the recesses while the surfaces of the recesses and the end parts are still at an elevated temperature.

5. Process according to claim 1, wherein the bonding operation is carried out while the end parts and the surfaces of the recesses are still at an elevated temperature produced by the drying operations.

6. Process according to claim 3 wherein the bonding operation is carried out while the end parts and the surfaces of the recesses are still at an elevated temperature produced by the drying operation.

7. Process according to claim 1, wherein the bonding operation is carried out while the end parts and the surfaces of the recesses are still at an elevated temperature produced by the drying operation.

8. Process according to claim 1 wherein the drying operations are controlled by temperature sensing.

9. Process according to claim 3, wherein the drying operation is controlled by temperature sensing.

10. Process according to claim 2, wherein the drying operation is controlled by temperature sensing.

11. Process according to claim 1, wherein the drying operations are subjected to timing control.

12. Process according to claim 3, wherein the drying operation is subjected to timing control.

13. Process according to claim 2, wherein the drying operation is subjected to timing control.

14. Process according to claim 1, wherein the electrical coils are located by raising and lowering.

15. Process according to claim 3, wherein the electrical coils are located by raising and lowering.

16. Process according to claim 2, wherein the electrical coil is located by raising and lowering.

17. Process according to claim 16, wherein the electrical coil is also movable in the direction of transportation of the bus bars located in the recesses of the carbon blocks and in a direction reverse thereto so that the drying operation is performed while the bus bars and carbon blocks are being transported.

* * * * *